US008851907B2

(12) United States Patent
Kim

(10) Patent No.: US 8,851,907 B2
(45) Date of Patent: Oct. 7, 2014

(54) CONTACT NODE OF PORTABLE TERMINAL

(75) Inventor: Yun-Sik Kim, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 13/226,716

(22) Filed: Sep. 7, 2011

(65) Prior Publication Data

US 2012/0156903 A1 Jun. 21, 2012

(30) Foreign Application Priority Data

Dec. 16, 2010 (KR) ..... 10-2010-0128955

(51) Int. Cl.
*H01R 12/00* (2006.01)
*H01R 12/70* (2011.01)
*H01R 31/02* (2006.01)

(52) U.S. Cl.
CPC ..... *H01R 12/7076* (2013.01); *H01R 31/02* (2013.01)
USPC ..... 439/81; 439/500; 439/862

(58) Field of Classification Search
USPC ..... 439/500, 862
See application file for complete search history.

(56) References Cited

U.S. PATENT DOCUMENTS

| | | | | |
|---|---|---|---|---|
| 7,611,391 | B2 * | 11/2009 | Long et al. | 439/862 |
| 2003/0216073 | A1 * | 11/2003 | Yeh | 439/188 |
| 2004/0121654 | A1 * | 6/2004 | Chao et al. | 439/660 |
| 2004/0161979 | A1 * | 8/2004 | Kyowski et al. | 439/660 |

* cited by examiner

*Primary Examiner* — Briggitte R Hammond
(74) *Attorney, Agent, or Firm* — Cha & Reiter, LLC.

(57) ABSTRACT

A contact node of a portable terminal includes: a body fixed on a main board of the portable terminal; at least one first contact piece protruding through one side surface of the body; and at least one second contact piece protruding through another side surface of the body, wherein one of the first contact piece and second contact piece is disposed toward an outer side surface of the portable terminal.

12 Claims, 5 Drawing Sheets

CONTACT NODE OF PORTABLE TERMINAL

CLAIM OF PRIORITY

This application claims the priority under 35 U.S.C. §119 of an application entitled "Contact Node Of Portable Terminal" filed in the Korean Intellectual Property Office on Dec. 16, 2010 and assigned Serial No. 10-2010-0128955, the contents of which are hereby incorporated by reference.

BACKGROUND OF THE INVENTION

1. Field of the Invention

The present invention relates to a portable terminal, and more particularly to a contact node of a portable terminal.

2. Description of the Related Art

In general, a portable terminal refers to an electronic device that allows multiple functions including voice communication and message transmission, storage of various information, and a multimedia service such as a game and a video. Such a portable terminal includes various types of devices including an electronic notebook, a palm personal computer, a portable gaming device, a video/music file player, a cellular phone, a laptop computer.

Such a portable terminal includes contact nodes for connecting various external devices. For example, a card slot for the connection of a SIM card or a memory card, an interface connector for charging or connection to a computer, an earphone jack, and a battery contact node are provided to a portable terminal.

Meanwhile, although there is a need to extend battery capacity due to the reinforcement of a multimedia function, there are many difficulties in extending battery capacity as a portable terminal is miniaturized. Thus, an auxiliary battery is often used to charge the battery of a portable terminal if needed while a user is carrying the portable terminal. Alternatively, a battery of a portable terminal to which a solar cell panel is mounted is available to charge on demand.

FIG. 1 illustrates a conventional battery contact node 1*a*, and FIG. 2 illustrates a conventional auxiliary power supply contact node 1*b*.

In the battery contact node 1*a*, contact pieces (hereinafter, 'first contact pieces') 3 protrude through one side surface, in particular, a front surface of a body 2 and fixing pieces 4 are formed on opposite side surfaces thereof respectively. In the auxiliary power supply contact node 1*b*, contact pieces 6 (hereinafter, 'second contact pieces') protrude through top end surfaces of bodies 5 respectively.

FIG. 3 illustrates the battery contact node 1*a* and the auxiliary power supply contact nodes 1*b* installed in a main board 13 of a portable terminal 10 (see FIG. 4). An earphone jack 15 and a camera module 17 may be disposed in the main board 13 in addition to the contact node 1*a* and 1*b*.

When the battery contact node 1*a* is installed in the main board 13, the first contact pieces 3 protrude through one side surface of the body 2 in a direction parallel to one surface of the main board 13. FIG. 4 illustrates a rear surface of a portable terminal 10 on which the main board 13 is mounted. A battery mounting recess 21 and a photographing opening 19 are disposed on the rear surface of the portable terminal 10. Meanwhile, as illustrated in FIG. 4, when the main board 13 is mounted to the portable terminal 10, the first contact pieces 3 protrude into the battery mounting recess 21.

When the auxiliary power supply contact node 1*b* is installed in the main board 13, the second contact pieces 6 protrude through a top end surface of the body 5 in a direction perpendicular to one surface of the main board 13. As illustrated in FIG. 4, when the main board 13 is mounted to the portable terminal 10, the second contact pieces 6 are exposed to the outside of the portable terminal 10. Preferably, the second contact pieces 6 protrude to the outside of the portable terminal 10 to provide a means for connecting an auxiliary power supply unit, such as a solar cell panel, configured to supply power to the portable terminal 10.

However, since the conventional contact nodes installed in the main board need to be connected to a battery pack, an auxiliary power supply cannot be provided without using preinstalled interface terminals. Thus, an auxiliary power supply contact node needs to be installed in a portable terminal to which a solar cell panel is mounted, in addition to a battery contact node. This requires the addition of a portable terminal assembling process, increasing material costs and thus increasing a product price. Also, there is a limit in miniaturizing a portable terminal due to a need to secure a space for installing an auxiliary power supply contact node.

SUMMARY OF THE INVENTION

Accordingly, the present invention has been made to solve the above-mentioned problems occurring in the prior art, and an aspect of the present invention provides a contact node of a portable terminal that allows simplification of an assembling process, reduction of material costs, and lowering of a product price.

Another aspect of the present invention provides a contact node of a portable terminal that allows an easier provision of an auxiliary power supply as well as simplification of an assembling process and reduction of material costs.

A further aspect of the present invention provides a contact node of a portable terminal that allows easier securing of an installation space and miniaturization of the portable terminal as well as provision of an auxiliary power supply.

In accordance with an aspect of the present invention, a contact node of a portable terminal includes: a body fixed on a main board of the portable terminal; at least one first contact piece protruding through one side surface of the body; and at least one second contact piece protruding through another side surface of the body, wherein one of the first contact piece and second contact piece is disposed toward an outer side surface of the portable terminal.

In the embodiment, three first contact pieces protrude through one side surface of the body, and the first contact piece or the three first contact pieces protrude through one side surface of the body in a direction parallel to one surface of the main board. A pair of second contact pieces protrudes through another side surface of the body, and the second contact piece or the pair of second contact pieces protrude through another side surface of the body in a direction perpendicular to one surface of the main board.

In more detail, the first contact piece protrudes through one side surface of the body in a direction parallel to one surface of the main board and the second contact piece protrudes through another side surface of the body in a direction perpendicular to the side surface of the main board.

Meanwhile, the first and second contact pieces are realized by a plate spring which is bent such that opposite ends thereof are supported within the body and a central portion thereof protrudes to the outside of the body.

The first and second contact pieces are realized by a plate spring opposite ends and a central portion of which are supported within the body, and a portion of the plate spring situated between one end and a central portion thereof protrudes through one side surface of the body to form the first contact piece and a portion of the plate spring situated between an opposite end and a central portion thereof protrudes through another side surface of the body to form the second contact piece.

Since the above-mentioned contact node is mounted to a portable terminal to provide a first contact piece for connection to a battery and a second contact piece for connection to a separate external device other than a battery, it can be easily connected to an auxiliary power supply using a solar cell panel or another device. Then, since a battery and an auxiliary power supply can be simultaneously connected to a single contact node, an inner space of the portable terminal as well as a main board can be efficiently used, thus contributing to miniaturization of the portable terminal. Also, since a single contact node is used without installing a separate auxiliary power supply contact node, material costs can be advantageously reduced and an assembling process can be simplified.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION

Hereinafter, exemplary embodiments of the present invention will be described in detail with reference to the accompanying drawings. For the purposes of clarity and simplicity, a detailed description of known functions and configurations incorporated herein will be omitted as it may make the subject matter of the present invention rather unclear.

Figure 1:
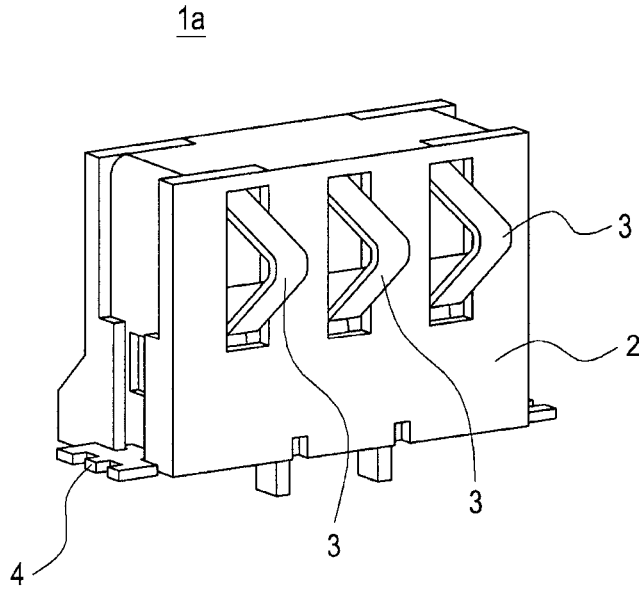
FIG.1 (PRIOR ART)
FIG. 1 is a perspective view illustrating a conventional battery contact node.
Figure 2:
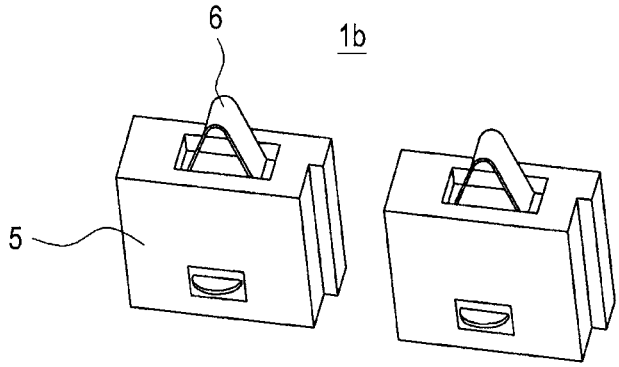
FIG.2 (PRIOR ART)
FIG. 2 is a perspective view illustrating a conventional auxiliary power supply contact node.
Figure 3:
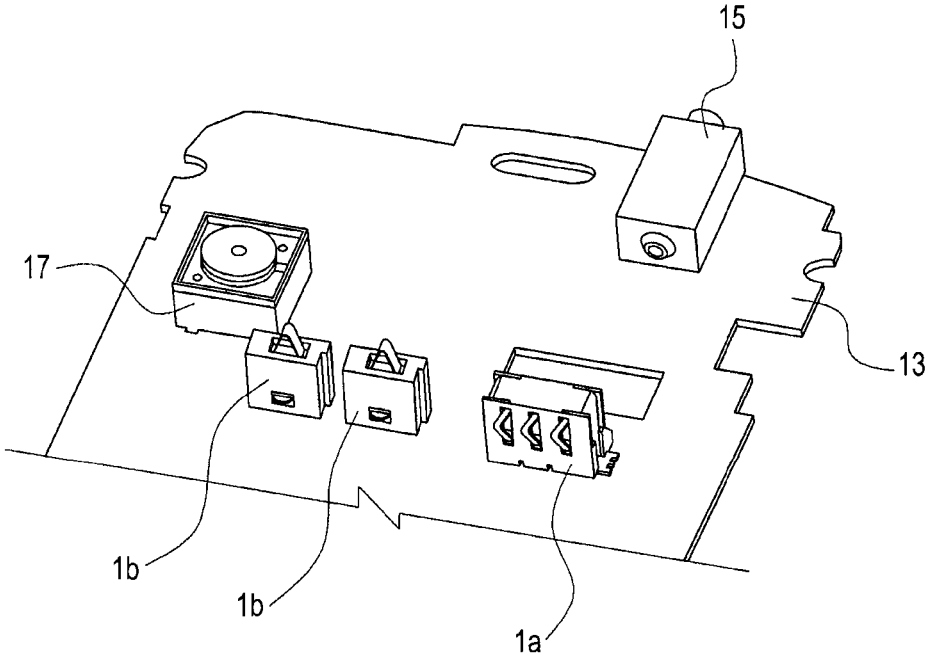
FIG.3 (PRIOR ART)
FIG. 3 is a perspective view illustrating a state where the contact nodes of FIGS. 1 and 2 are installed in a main board.
Figure 4:
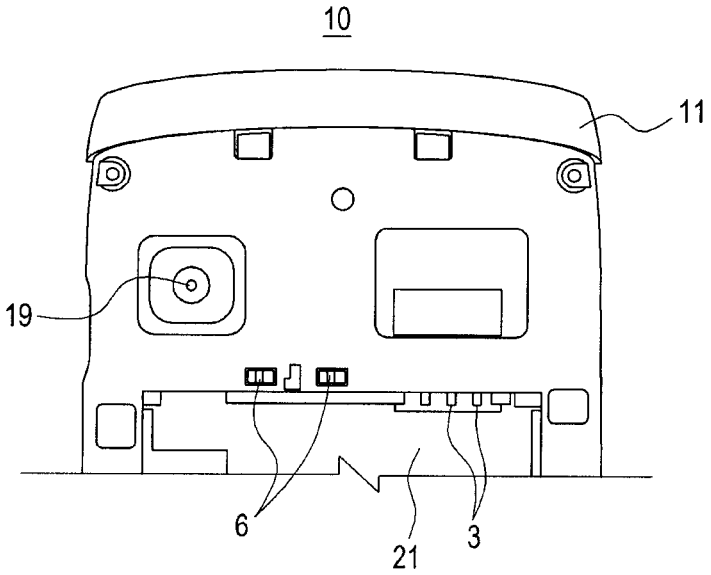
FIG.4 (PRIOR ART)
FIG. 4 is a top view illustrating a portable terminal having the main board of FIG. 3.
Figure 5:
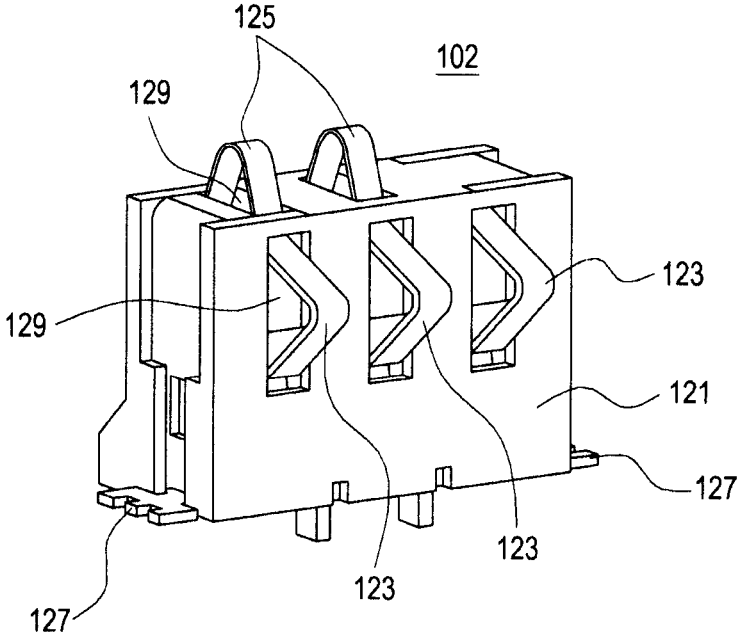
FIG. 5 is a perspective view illustrating a contact node of a portable terminal according to an embodiment of the present invention.

FIG. 5 is a perspective view illustrating a contact node 102 of a portable terminal 100 (see FIG. 7) according to an embodiment of the present invention. As illustrated in FIG. 5, the contact node 102 of a portable terminal 100 according to the embodiment of the present invention includes a body 121, and first and second contact pieces 123 and 125. The first or second contact pieces 123 or 125 are disposed toward the outside of the portable terminal 100.

The body 121 is made of a synthetic resin, and includes slots 129 through which the first and second contact pieces 123 and 125 protrude. In addition, fixing pieces 127 are installed on at least two opposite sides of the body 121 to provide a means for fixing the contact node 121 to the main board 113 (see FIG. 6) of the portable terminal 100.

Figure 6:
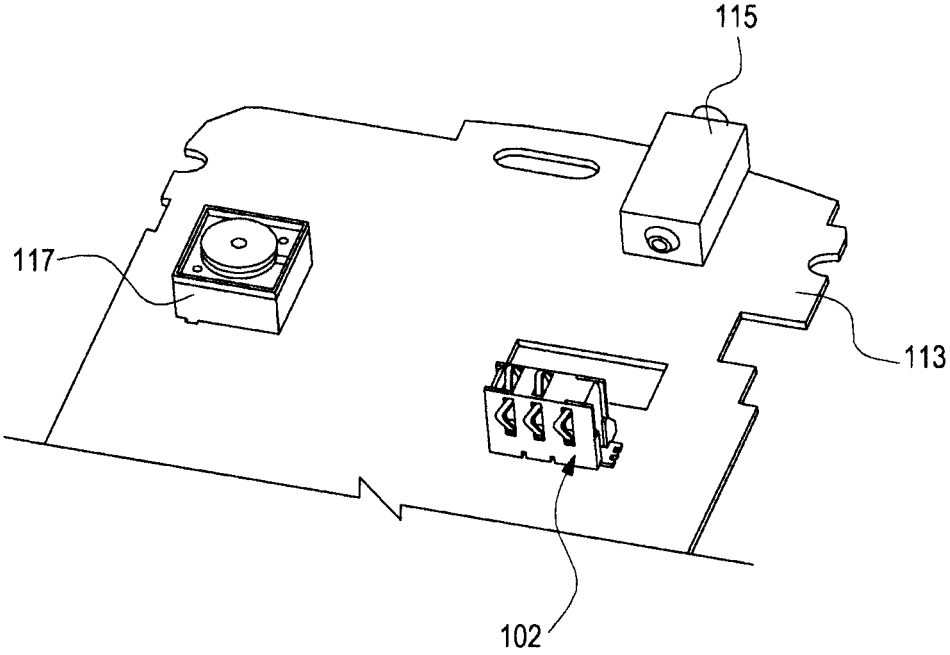
FIG. 6 is a perspective view illustrating a state where the contact node of FIG. 5 is installed in a main board of the portable terminal.

At least one and preferably three first contact pieces 123 are disposed on one side surface of the body 121. Referring further to FIG. 6, when the body 121 is fixed to the main board 113, the first contact pieces 123 protrude in a direction parallel to one surface of the main board 113.

At least one second contact piece 125 is disposed on another side surface, preferably on a top end surface of the body 121. In the embodiment of the present invention, it is illustrated that a pair of second contact pieces 125 protrude through a top end surface of the body 121. Referring further to FIG. 6, when the body 121 is fixed to the main board 113, the second contact pieces 125 protrude in a direction perpendicular to one surface of the main board 113.

It should be noted that the number of contact pieces 123 and 125 show in the drawings is for illustrative purposes, thus should not limit the scope of the invention. As such, it should be noted that the teachings of the present invention is applicable to different number of combination of contact pieces.

Preferably, the first and second contact pieces 123 and 125 are realized by plate springs. In this case, opposite ends of each plate spring are supported within the body 121 and a central portion between opposite ends thereof is bent to protrude through one side surface or another side surface of the body 121 through a slot 129 corresponding to it. The first and second contact pieces 123 and 125 are formed in this way.

In addition, it can be seen that in the contact node 102 of FIG. 5, the first contact pieces 123 disposed at a left end portion and a central portion of the body 121 form pairs with the second contact pieces 125 respectively. In this case, each pair of first and second contact pieces may be realized by one plate spring. In detail, opposite ends and a central portion of one plate spring are supported within the body, and a portion of the plate spring situated between one end and a central portion of the plate spring is bent to protrude through one side surface of the body, forming the first contact piece disposed at a left end portion or a central portion of the body. A portion of the plate spring situated between an opposite end and a central portion of the plate spring is bent to protrude through another side surface of the body, forming the second contract piece.

In the embodiment of the present invention, although the three first contact pieces 123 and the pair of second contact pieces 125 are disposed such that the first and second contact pieces do not form pairs perfectly, a spare second contact node may be added. In this case, all the first and second contact pieces form pairs such that each pair of first and second contact pieces can be realized by one plate spring.

Circuit modules and communication circuits for controlling an overall operation of the portable terminal 100 are disposed in the main board 113, and an earphone jack 115 and a camera module 117 are disposed in the main board 113 in addition to the contact node 102.

Figure 7:
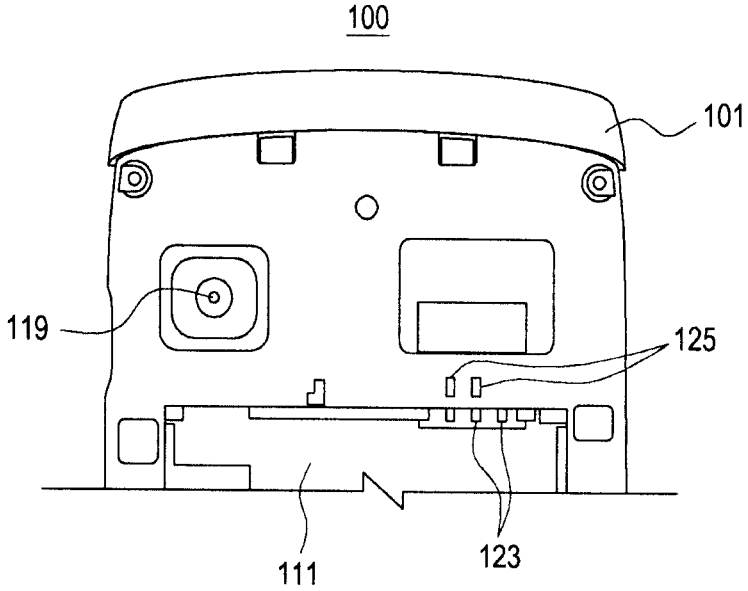
FIG. 7 is a top view illustrating a portable terminal having the main board of FIG. 6.

FIG. 7 is a top view illustrating a portable terminal 100 to which the main board 113 is mounted, in more detail, a rear surface of the portable terminal 100. Although a bar-type portable terminal is exemplified in the figure, an additional housing may be rotatably or slidably coupled to the housing 101 of FIG. 7 to form a folder-type portable terminal or a sliding-type portable terminal.

Figure 8:
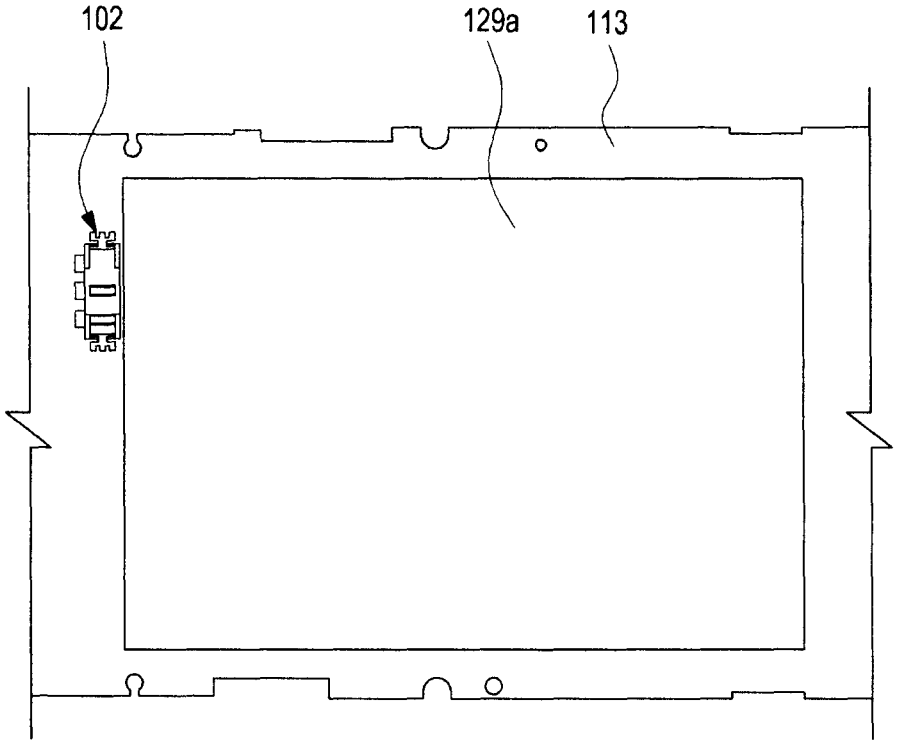
FIG. 8 is a top view illustrating a state where the contact node of FIG. 6 is connected to a battery pack.

A battery mounting recess 111 and a photographing opening 119 may be formed on the rear surface of the housing 101 of the portable terminal 100. When the main board 113 is disposed within the housing 101, a camera module 117 may be situated at a location corresponding to the photographing opening 119 to take a video or photo through the photographing opening 119. Meanwhile, the first contact pieces 123 of the contact node 102 protrude to the outside of the housing 101 and are situated on the battery mounting recess 111. As mentioned above, the first contact pieces 123 protrude on one side surface of the body 121 in a direction parallel to one surface of the main board 113. Thus, the first contact pieces 123 will be situated on a wall of the battery mounting recess 111, and as illustrated in FIG. 8, will be connected to a power supply node of the battery pack 129*a* (see FIG. 8) to be mounted on the battery mounting recess 111. The second pieces 125 of the contact node 102 protrude through one side surface of the body 121 in a direction perpendicular to one surface of the main board 113 to the outside of the housing 101.

Figure 9:
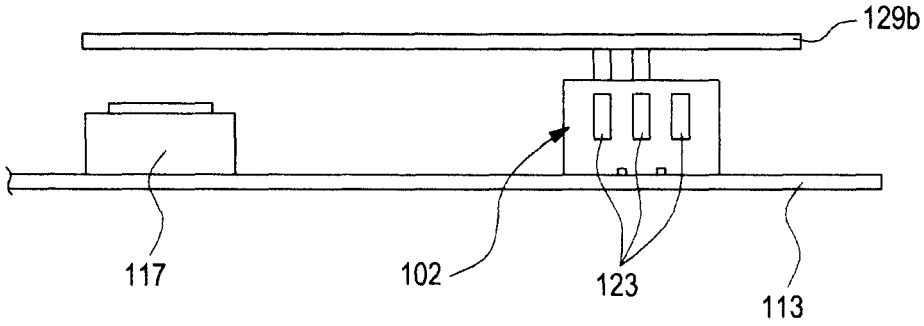
FIG. 9 is a side view illustrating a state where a solar cell panel is connected to the contact node of FIG. 6.

The battery mounting recess 111 is hidden by a battery cover (not shown), and protruding regions of the second contact pieces 125 also closed by the battery cover. Then, if the battery cover includes an auxiliary power supply unit such as a solar cell panel 129*b* (see FIG. 9), auxiliary power can be supplied to the battery pack 129*a* or the portable terminal 100 through the second contact pieces 125. FIG. 9 illustrates connection of a solar cell panel 129*b* to the second contact pieces 125. Meanwhile, although the solar cell panel 129*b* can directly supply electric power to the portable terminal 100, it is actually impossible to stably supply electric power through the solar cell panel 19*b* for a certain period of time since a user uses the portable terminal 100 while holding it. Thus, the solar cell panel 129*b* is preferably utilized as an auxiliary power supply for charging the battery pack 129*a*.

Meanwhile, it has been illustrated that auxiliary power is supplied through the contact node 102 in the embodiment of the present invention, the contact node 102 may be utilized to connect the portable terminal 100 to another device. For example, although Bluetooth headsets are being commonly used, they also need to be charged through separate charging devices. Then, a Bluetooth headset may be connected to the battery pack 129*b* of the portable terminal 100 through the second contact pieces 125 such that the battery pack 129*b* can be used as a power supply for charging the Bluetooth headset. Also, an expansion keyboard docked with the portable terminal 100 to be utilized may be connected to the battery pack 129*b* through the second contact pieces 125 such that the battery pack 129*b* can be utilized as a power supply of the expansion keyboard. In addition, the second contact pieces 125 may be used to connect devices such as a portable beam projector to a portable terminal. Meanwhile, it is preferable that a manufacturer limits the types of devices connectable through the second contact pieces 129*b* due to the limited capacity of the battery pack 129*b*.

Since the above-mentioned contact node is mounted to a portable terminal to provide a first contact piece for connection to a battery and a second contact piece for connection to a separate external device other than a battery, it can be easily connected to an auxiliary power supply using a solar cell panel or another device. As a battery and an auxiliary power supply can be simultaneously connected to a single contact node, an inner space of the portable terminal as well as a main board can be efficiently used, thus further contributing to miniaturization of the portable terminal.

While the invention has been shown and described with reference to a certain embodiment thereof, it will be understood by those skilled in the art that various changes in form and details may be made therein without departing from the spirit and scope of the invention as defined by the appended claims.

What is claimed is:

1. A contact node of a portable terminal, comprising:

a monolithic contact node body coupled to a main board of the portable terminal;

a plurality of first contact pieces protruding through one side surface of the contact node body; and a plurality of second contact pieces protruding through another side surface of the contact node body, wherein one of the plurality of first contact pieces and the plurality of second contact pieces is disposed toward an exterior surface of the portable terminal and wherein when at least some first contact pieces and second contact pieces are formed in contiguous pairs and the contact node is configured to connect to two power sources comprising a battery and an auxiliary power supply that are simultaneously connected on opposite ends of at least one first plate spring, and wherein at least one of the plurality of first contact pieces or the plurality of second contact pieces that are not formed in contiguous pairs is exclusively arranged on a second plate spring.

2. The contact node as claimed in claim 1, wherein three first contact pieces protrude through one side surface of the body.

3. The contact node as claimed in claim 1, wherein the first contact pieces protrude through one side surface of the body in a direction substantially parallel to one surface of the main board.

4. The contact node as claimed in claim 1, wherein the second contact pieces protrude through another side surface of the body in a direction substantially perpendicular to one surface of the main board.

5. The contact node as claimed in claim 1, wherein the first contact pieces protrude through one side surface of the body in a direction substantially parallel to one surface of the main board and the second contact pieces protrude through another side surface of the body in a direction substantially perpendicular to the one surface of the main board.

6. The contact node as claimed in claim 1, wherein the first and second contact pieces are comprised of plate springs which are bent such that opposite ends thereof are positioned within the contact node body and a central portion thereof protrudes to the outside of the contact node body.

7. A portable terminal comprising:

a housing having a main board;

a monolithic contact node body coupled to the a main board;

a plurality of first contact pieces protruding through one side surface of the contact node body to electrically contact a first device; and a plurality of second contact pieces protruding through another side surface of the contact node body to electrically contact a second device, wherein one of the first contact pieces and the second contact pieces is disposed toward an exterior surface of the portable terminal and wherein when at least one first contact pieces and the second contact pieces comprise a plurality of first and second contact pieces, some of the first and the second contact pieces are formed in contiguous pairs respectively arranged on opposite ends of a first plate spring, and wherein at least one of the first and second contact pieces that are not formed in contiguous pairs is exclusively arranged on a second plate spring, and wherein the contact node body has slots to connect to two power sources comprising a battery and an auxiliary power supply that are simultaneously connected on opposite ends of at least the one first plate spring.

8. The portable terminal as claimed in claim 7, wherein three first contact pieces protrudes through one side surface of the body in a direction substantially parallel to one surface of the main board.

9. The portable terminal as claimed in claim 7, wherein a pair of second contact pieces protrudes through another side surface of the body.

10. The portable terminal as claimed in claim 7, wherein the second contact pieces protrude through another side surface of the body in a direction substantially perpendicular to one surface of the main board.

11. The portable terminal as claimed in claim 7, wherein the first contact pieces protrude through one side surface of the body in a direction substantially parallel to one surface of the main board and the second contact pieces protrude through another side surface of the body in a direction substantially perpendicular to the one surface of the main board.

12. The portable terminal as claimed in claim 7, wherein the first and second contact pieces comprise plate springs which are bent such that opposite ends thereof are positioned within the contact node body and a central portion thereof protrudes to the outside of the contact node body.

* * * * *

UNITED STATES PATENT AND TRADEMARK OFFICE

CERTIFICATE OF CORRECTION

PATENT NO. : 8,851,907 B2
APPLICATION NO. : 13/226716
DATED : October 7, 2014
INVENTOR(S) : Yun-Sik Kim It is certified that error appears in the above-identified patent and that said Letters Patent is hereby corrected as shown below:

In the Claims

Column 6, Claim 7, Line 42 should read as follows:
--...coupled to the main...--

Signed and Sealed this
Thirtieth Day of December, 2014

Michelle K. Lee

Michelle K. Lee
*Deputy Director of the United States Patent and Trademark Office*